US007464435B2

(12) United States Patent
Young

(10) Patent No.: US 7,464,435 B2
(45) Date of Patent: Dec. 16, 2008

(54) MOP WRINGER AND ADAPTOR

(76) Inventor: Ronald Alexander Young, 95 Mushroom Green, Dudley Wood, West Midlands, DY2 0EE (GB)

( * ) Notice: Subject to any disclaimer, the term of this patent is extended or adjusted under 35 U.S.C. 154(b) by 621 days.

(21) Appl. No.: 10/918,475

(22) Filed: Aug. 16, 2004

(65) Prior Publication Data

US 2006/0032011 A1 Feb. 16, 2006

(51) Int. Cl.
*A47L 13/59* (2006.01)

(52) U.S. Cl. ..... 15/261; 15/260

(58) Field of Classification Search ..... 15/260–263
See application file for complete search history.

(56) References Cited

U.S. PATENT DOCUMENTS

| | | | |
|---|---|---|---|
| 1,504,990 | A | 8/1924 | Stafford |
| 1,886,184 | A | 11/1932 | Heber |
| 5,727,281 | A | 3/1998 | Harper |
| 2002/0116780 | A1 | 8/2002 | Young |
| 2006/0143850 | A1 | 7/2006 | Young |

FOREIGN PATENT DOCUMENTS

| | | | |
|---|---|---|---|
| EP | 910983 | * | 4/1999 |
| GB | 2 372 430 | | 8/2002 |
| JP | 8-182645 | * | 7/1996 |
| WO | WO 00/19882 | | 4/2000 |

* cited by examiner

*Primary Examiner*—Mark Spisich
(74) *Attorney, Agent, or Firm*—Young & Thompson

(57) ABSTRACT

A mop wringer is provided in combination with an adaptor. The mop wringer comprises a base and one or more sides which are formed as a one-piece moulding and which define an unadapted channel in which a stranded mop head can be wrung out. The mop wringer also has one or more openings in the base and/or the side(s) through which fluid can drain. The adaptor is releasably insertable into the wringer to define either alone or together with the wringer an adapted channel which is of smaller cross-sectional dimensions than the unadapted channel and in which a head of a flat mop can be wrung out.

2 Claims, 5 Drawing Sheets

FIG 7
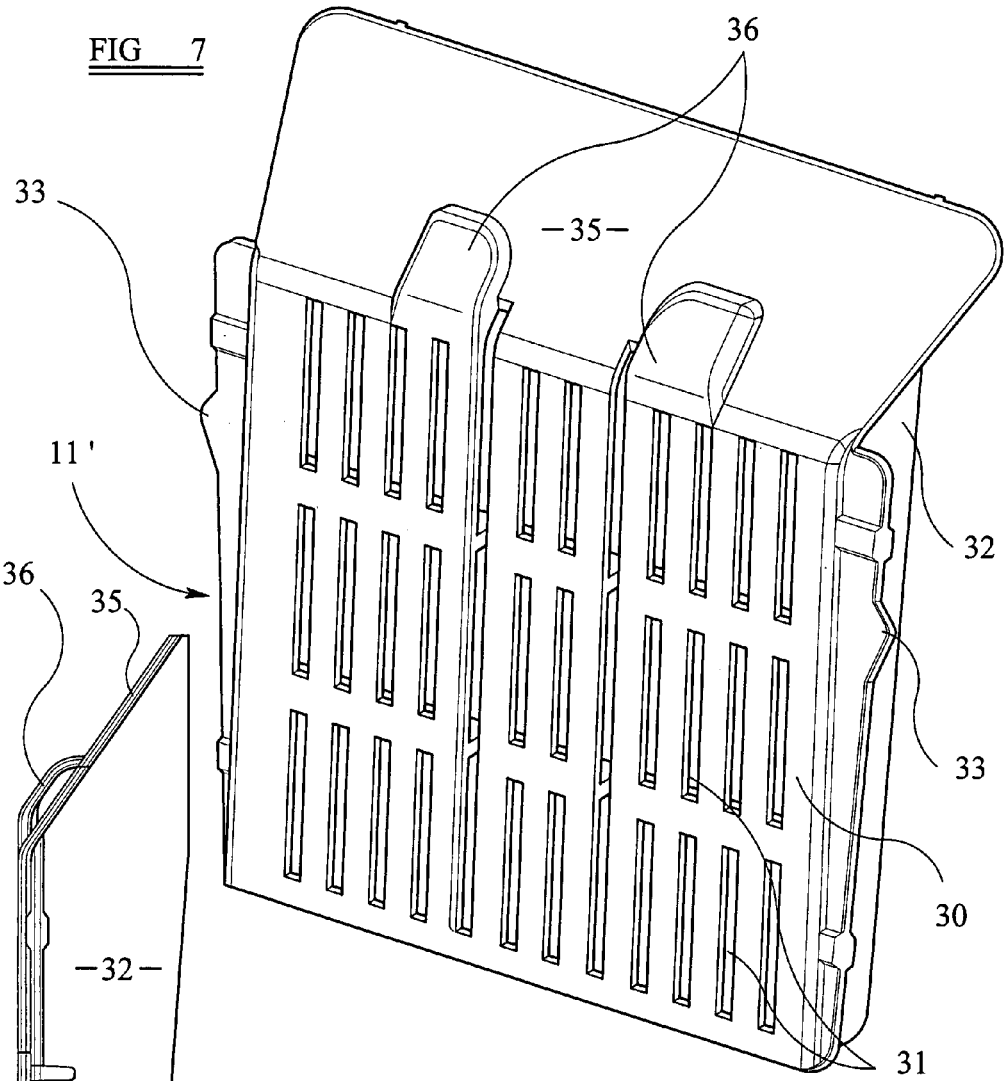
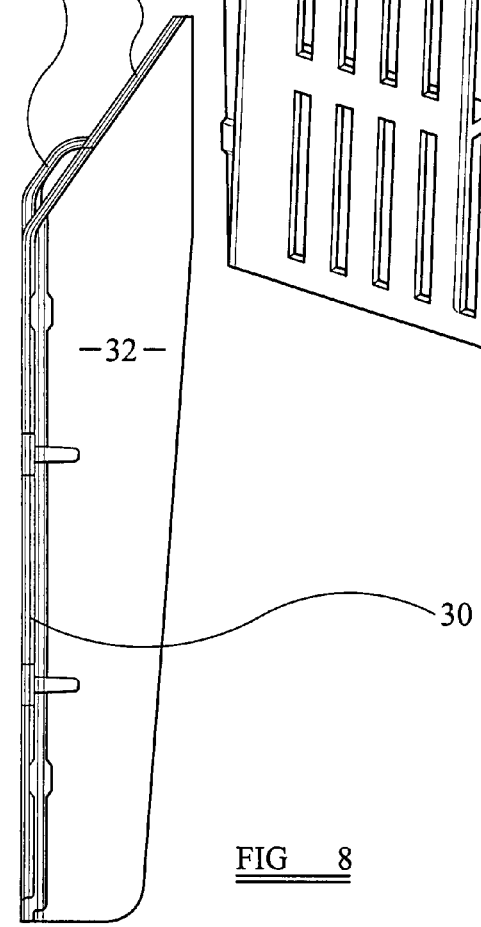
FIG 8

MOP WRINGER AND ADAPTOR

This invention relates to a mop wringer and adaptor.

Mops come in various forms. Generally speaking, all mops have a mop head comprising a body and absorbent material supported by the body. Many mop heads are so-called "stranded" mop heads which comprise a bundle of strands which are clamped to and hang down from the body of the mop head. Other mops have a flat mop head comprising a pad of absorbent material attached to a body comprising two or more hinged parts which can be releasably locked together in an operative condition in which the absorbent pad is stretched or pulled across the underside of the body and which can be released to occupy an inoperative condition in which the absorbent pad can hang down from the body so that it can be wrung out. Current wringers are specifically designed to either receive a stranded mop head or a flat mop head and cannot be used to wring out both types of mop head in a satisfactory manner.

SUMMARY OF THE INVENTION

According to one aspect of the present invention, there is provided a mop wringer in combination with an adaptor, the mop wringer comprising a base and one or more sides which define an unadapted channel and which have one or more openings therein through which fluid can drain and the adaptor being releasably insertable into the wringer to define either alone or together with the wringer an adapted channel having fixed sides and smaller cross-sectional dimensions than the unadapted channel.

It is thus possible to use a mop wringer and adaptor combination according to the invention for wringing out stranded mop heads and flat mop heads.

Preferably, the adaptor is snap fittably insertable in the wringer.

The adaptor may be in the form of a perforated basket having outwardly extending spacers for locating it in the channel of the wringer or may be in the form of a plate-like element.

According to another aspect of the invention there is provided a wringer-channel adaptor for use with a wringer for a mop, the adaptor comprising at least one side and means for retaining the adaptor in releasable engagement with the wringer when located therein, the in use adaptor being located in an unadapted channel defined by sides of the wringer to provide an adapted channel having fixed sides and smaller cross-sectional area than that of the unadapted channel.

The invention will now be more particularly described, by way of example, with reference to the accompanying drawings.

BRIEF DESCRIPTION OF THE DRAWINGS

FIG. 7 is a perspective view of the adaptor shown in FIG. 6, and FIG. 8 is a side view of the adaptor shown in FIG. 7.

DESCRIPTION OF THE PREFERRED EMBODIMENTS

Figure 1:
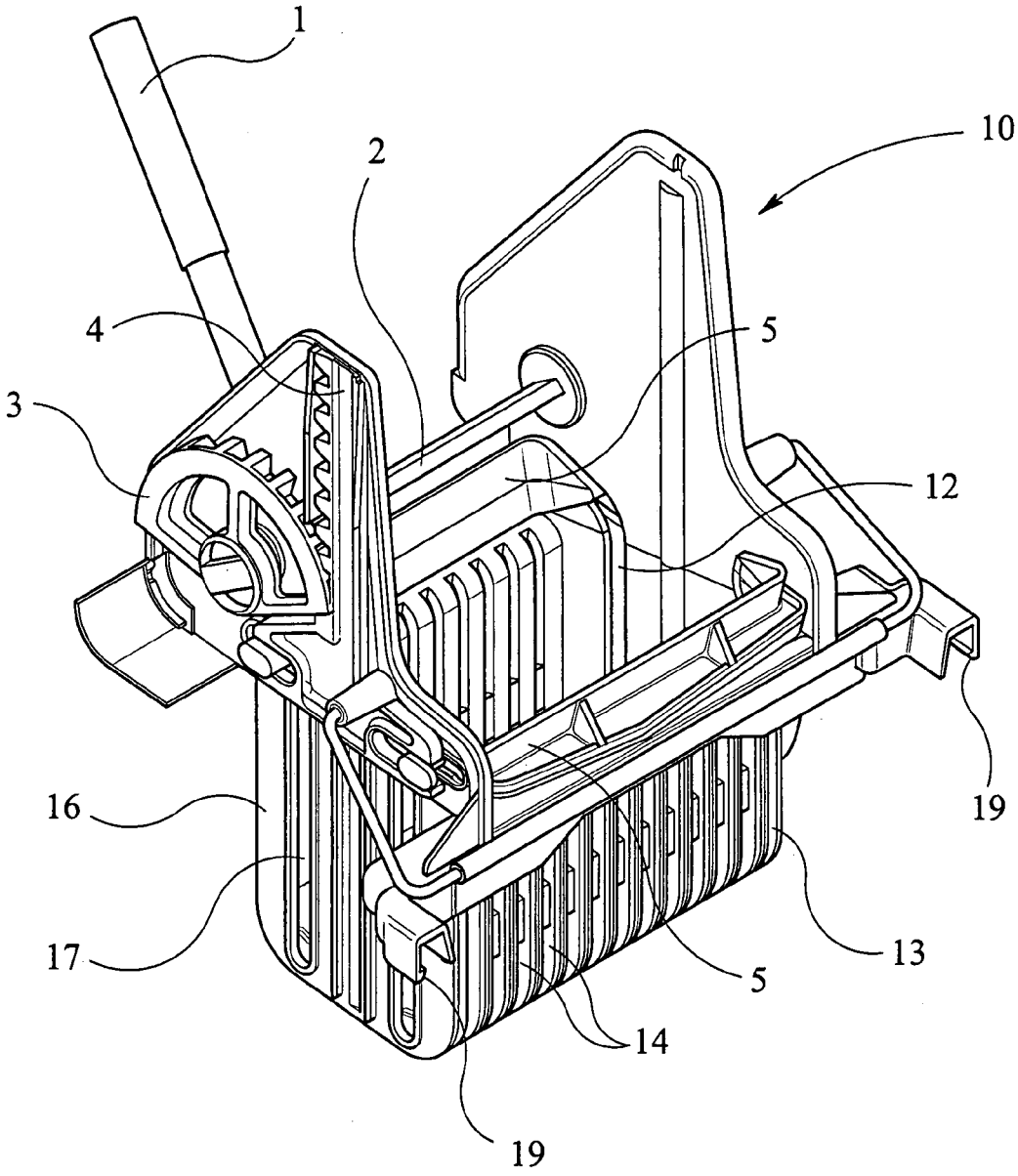
FIG. 1 is a perspective view of one embodiment of a mop wringer for use in combination with an adaptor according to the present invention.
Figure 2:
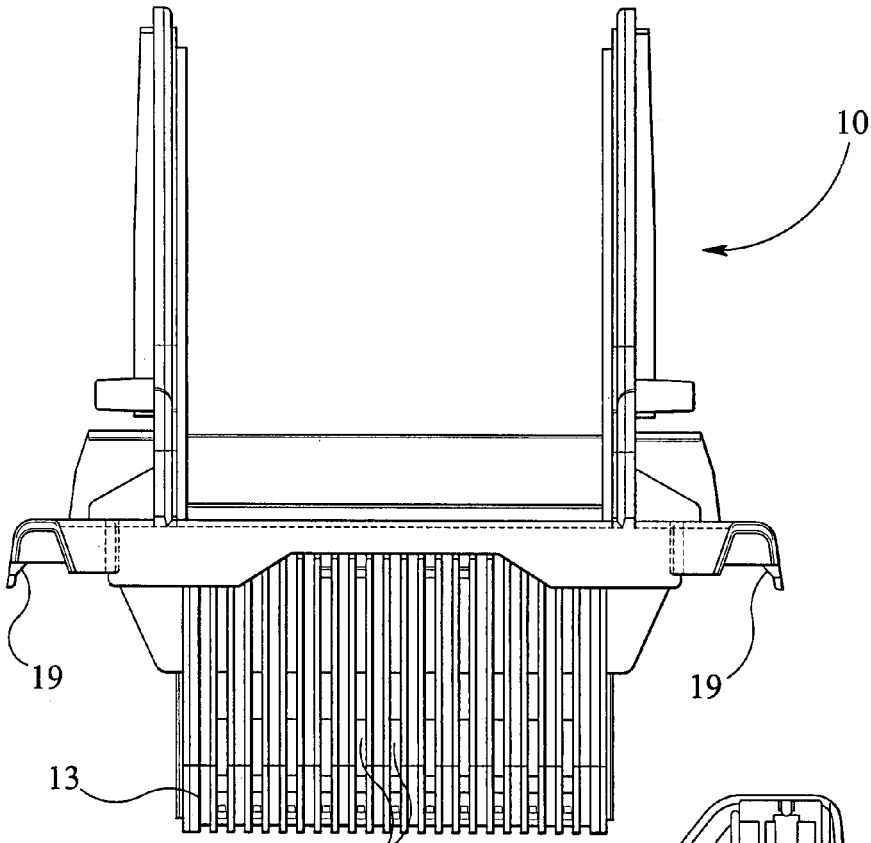
FIG. 2 is a front view of the mop wringer shown in FIG. 1 with the wringer mechanism omitted for clarity.
Figure 3:
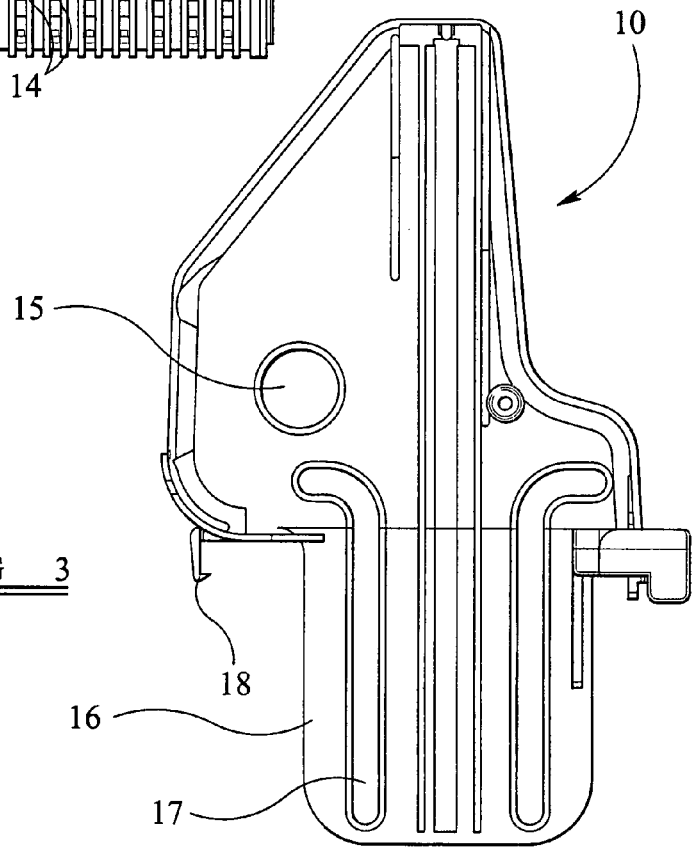
FIG. 3 is a side view of the mop wringer shown in FIG. 1 with the wringer mechanism omitted for clarity.
Figure 4:
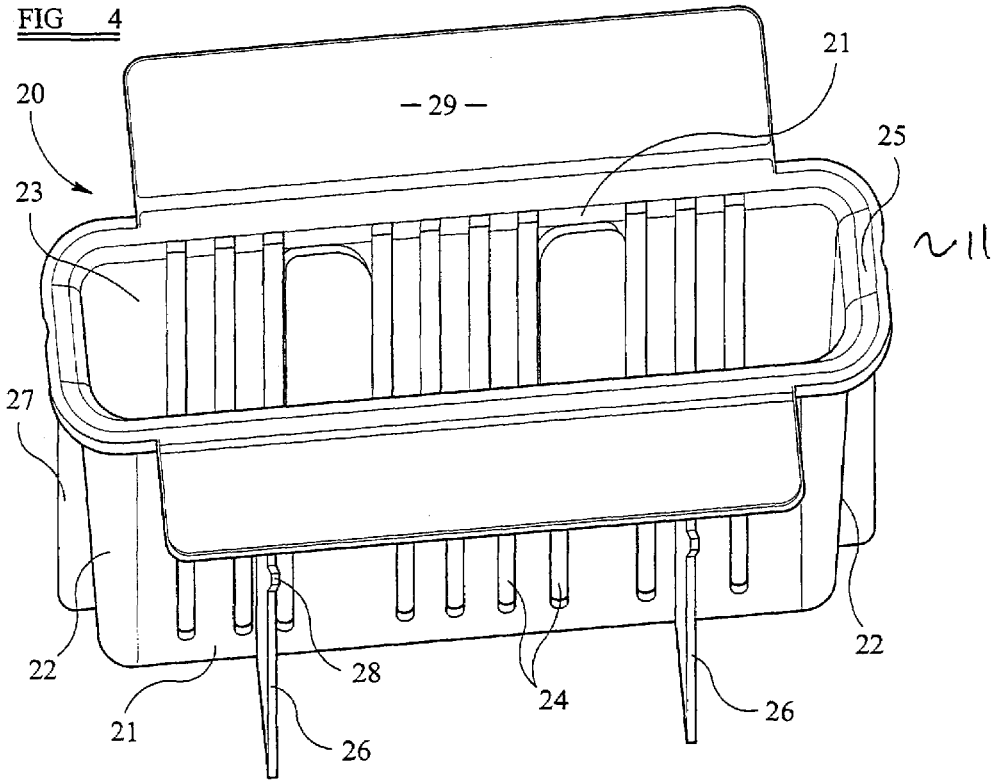
FIG. 4 is a perspective view of one embodiment of an adaptor for use in combination with the mop wringer shown in FIGS. 1 to 3 on an enlarged scale.
Figure 5:
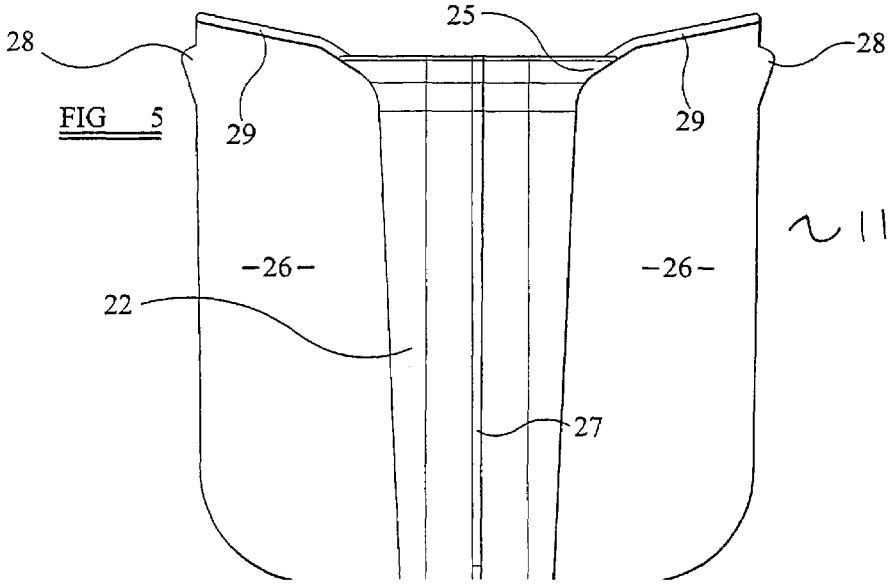
FIG. 5 is an end view of the adaptor shown in FIG. 4.

FIGS. 1 to 3 of the drawings show therein a wringer 10 and FIGS. 4 & 5 show an adaptor 11 for use in combination with the wringer 10.

The wringer 10 shown in FIG. 1 to 3 is a conventional stranded mop wringer provided with a wringing mechanism comprising a lever handle 1 for rotating a shaft 2 supporting a segment gear 3 which meshes with a rack 4 and lowers pressure bars 5 to exert pressure on the top of a mop inserted in the wringer 10.

The wringer 10 comprises a body having a base and four sides which are formed as a one piece moulding and which define a channel 12 in which a stranded mop head can be wrung out. The body of the wringer 10 is of substantially rectangular shape and has openings 14 in its base and longer sides 13 through which fluid can drain. Circular holes 15 (see FIG. 3) in the shorter sides 16 support the shaft 2 of the wringer mechanism and the elongate slots 17 (see FIG. 3) in the shorter sides 16 serve as guides for pressure bars 5 of the wringing mechanism.

The wringer 10 can be mounted on the rear wall of a container, typically in the form of a bucket mounted on castors, and has hook-like formations 18 (see FIG. 3) which hook under the rim of the rear wall of the bucket and further hook-like formations 19 which hook under the rim along opposite sides of the bucket.

The adaptor 11 comprises a perforated basket 20 of substantially rectangular shape. The basket 20 has two long walls 21 and two shorter end walls 22. The basket 20 defines a channel 23 in which a head of a flat mop can be wrung out. The base and two long walls 21 of the basket have openings in the form of elongate slots 24 through which liquid can drain into the wringer 10 and thence into the bucket. The upper end of the basket 20 has an outwardly flared rim 25 in order to assist in guiding the head of the flat mop into the channel 23. Each long wall 21 of the basket 20 has two outwardly extending fin-like spacers 26 which co-operate with the longer sides 13 of the wringer 10 to locate the basket 20 centrally within the wringer 10. Each shorter end wall 22 also has a single outwardly extending fin-shaped spacer 27 for co-operating with the shorter sides 16 of the wringer 10. Each spacer 26 has a protuberance 28 adjacent to its upper end for snap fit engagement with the wringer 10. The adaptor 11 also has wing-like projections 29 extending outwardly from the upper edge of its rim 25 above the spacers 26 to further assist in guiding the head of a flat mop into the channel 23.

The wringer 10 can be used in conventional manner to wring out stranded mop heads. If it is desired to use the wringer 10 to wring out a flat mop head, the adaptor described above is inserted in the channel 12 of the wringer 10.

Figure 6:
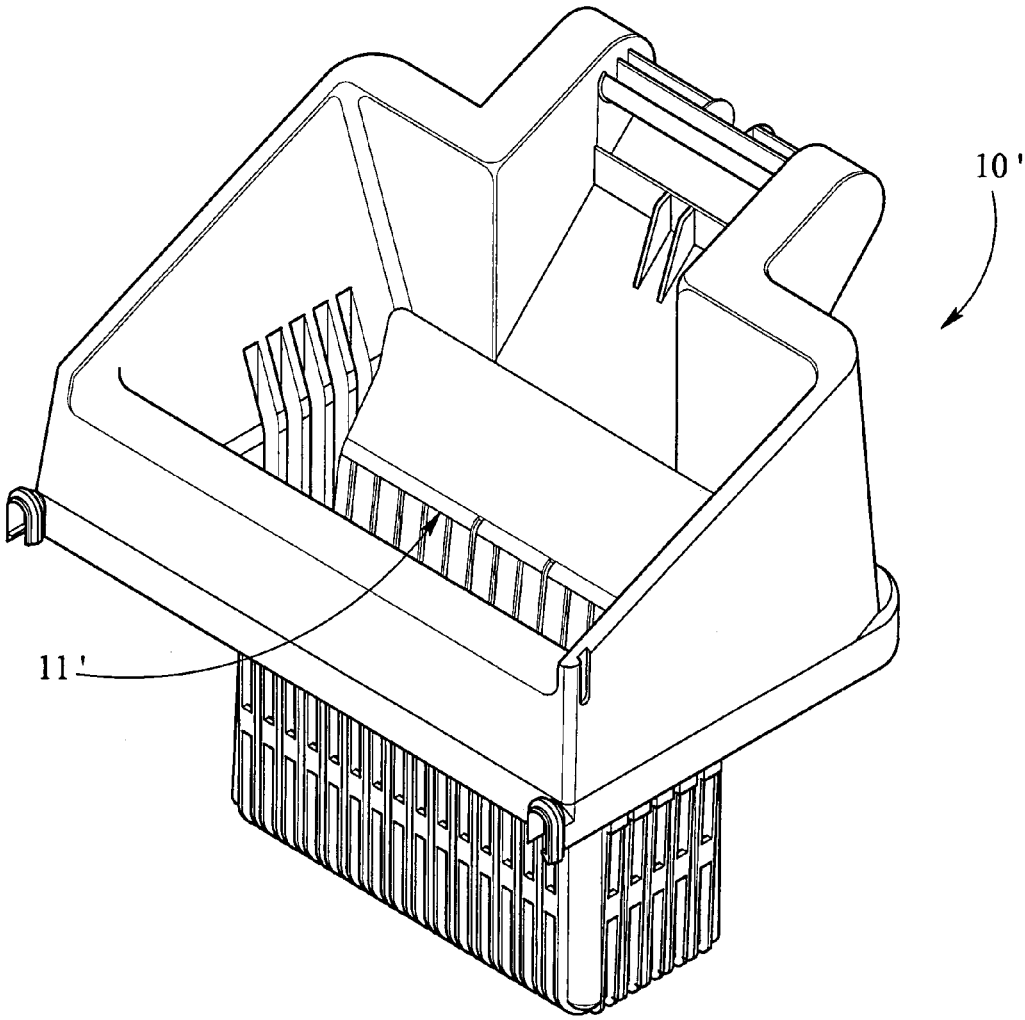
FIG. 6 is a perspective view of a different type of mop wringer and adaptor.

FIG. 6 shows a wringer 10' of the type disclosed in GB-A-2372430 which has no wringing mechanism as such but which relies on the relative dimensions of the mop and the channel of the wringer body to prevent or substantially prevent fluid expelled or discharged from the mop from rising above the mop head. An adaptor 11' is shown mounted in the wringer 10'.

FIGS. 7 & 8 show the adaptor 11'. This adaptor 11' comprises a perforated plate 30 having openings therein in the form of slots 31. Two fin-like spacers 32 extend outwardly from the rear surface of plate 30 to support the adaptor plate 30 in spaced relationship to the rear longer side 13 of the wringer 10. Each end of the plate 30 also has a protuberance 33 for snap fit engagement with a respective shorter side 16 of the wringer 10.

When this adaptor 11' is snap fittably engaged in the channel 12 of the wringer it will, together with the longer front side 13 and part of each shorter side 16 of the wringer, define a channel which is smaller than the unadapted channel 12 and which is dimensioned to receive the head of a flat mop.

The adaptor 11' has a wing-like portion 35 extending outwardly and upwardly from the upper end of the plate 30 above the spacers 32.

The adaptor 11' also has two guides 36 for guiding the body of a flat mop head centrally into the channel defined between the adaptor 11' and the wringer 10'.

The embodiments described above are given by way of example only and various modifications will be apparent to persons skilled in the art without departing from the scope of the invention as defined by the appended claims.

What is claimed is:

1. A mop wringer in combination with an adaptor, the mop wringer comprising a base and one or more sides which define an unadapted channel and which have one or more openings therein through which fluid can drain and the adaptor being releasably insertable into the wringer to define either alone or together with the wringer an adapted channel having fixed sides and smaller cross-sectional dimensions than the unadapted channel having fixed sides and smaller cross-sectional dimensions than the unadapted channel, wherein the adaptor is in the form of a perforated basket having outwardly extending spacers for locating it in the unadapted channel of the wringer, and wherein the wringer and basket are of substantially rectangular cross sectional shape and wherein the basket has two spacers extending from each of its two longer sides for co-operating with the two longer sides of the wringer.

2. A combination as claimed in claim 1, wherein the basket has wings extending from each of its two longer sides above the spacers.

* * * * *

UNITED STATES PATENT AND TRADEMARK OFFICE

CERTIFICATE OF CORRECTION

PATENT NO. : 7,464,435 B2
APPLICATION NO. : 10/918475
DATED : December 16, 2008
INVENTOR(S) : Ronald Alexander Young It is certified that error appears in the above-identified patent and that said Letters Patent is hereby corrected as shown below:

Column 4, lines 1-18, claim 1 should read as follows:

A mop wringer in combination with an adaptor, the mop wringer comprising a base and one or more sides which define an unadapted channel and which have one or more openings therein through which fluid can drain and the adaptor being releasably insertable into the wringer to define either alone or together with the wringer an adapted channel having fixed sides and smaller cross-sectional dimensions than the unadapted channel, wherein the adaptor is in the form of a perforated basket having outwardly extending spacers for locating it in the unadapted channel of the wringer, and wherein the wringer and basket are of substantially rectangular cross sectional shape and wherein the basket has two spacers extending from each of its two longer sides for co-operating with the two longer sides of the wringer.

Signed and Sealed this
Twenty-sixth Day of February, 2013

Teresa Stanek Rea
*Acting Director of the United States Patent and Trademark Office*